US009459002B2

(12) United States Patent
Vogt et al.

(10) Patent No.: US 9,459,002 B2
(45) Date of Patent: Oct. 4, 2016

(54) LAMP HOLDER FOR RECEIVING A LAMP WITH HOLDER HOUSING COMPONENT LIFTABLE AGAINST SPRING FORCE

(71) Applicant: BJB GmbH & Co. KG, Arnsberg (DE)

(72) Inventors: Karl-Wilheim Vogt, Ense (DE); Markus Pieper, Arnsberg (DE)

(73) Assignee: BJB GmbH & Co. KG, Arnsburg (DE)

( * ) Notice: Subject to any disclaimer, the term of this patent is extended or adjusted under 35 U.S.C. 154(b) by 12 days.

(21) Appl. No.: 14/461,584

(22) Filed: Aug. 18, 2014

(65) Prior Publication Data

US 2015/0078013 A1 Mar. 19, 2015

Related U.S. Application Data

(63) Continuation of application No. PCT/DE2012/001202, filed on Dec. 14, 2012.

(51) Int. Cl.

| | |
|---|---|
| ***H01R 33/46*** | (2006.01) |
| ***F21V 19/00*** | (2006.01) |
| ***F21V 19/04*** | (2006.01) |

(Continued)

(52) U.S. Cl.

CPC ..... *F21V 29/50* (2015.01); *F21K 9/30* (2013.01); *F21V 19/006* (2013.01); *F21V 19/0045* (2013.01); *F21V 29/004* (2013.01); *H01R 33/46* (2013.01); *F21V 17/14* (2013.01)

(58) Field of Classification Search

CPC ..... F21V 19/0045; F21V 17/14; F21V 19/0005; F21V 19/001; F21V 19/0025; F21V 19/003; F21V 19/0035; F21V 19/004; F21V 19/0055; F21V 19/006; F21V 19/007; F21V 19/0095; F21V 19/042; F21V 17/002; F21V 17/005; F21V 17/162; F21V 17/166; F21V 17/168; F21V 17/18; F21V 23/06; F21V 29/002; F21V 29/004; F21V 29/20; F21V 29/50; F21V 29/502; F21V 29/507; F21V 29/70; F21V 29/71; F21V 29/713; H01R 33/46; H01R 33/0809; H01R 33/0836–33/0854; H01R 33/465; H01R 33/90; H01R 33/9456; H01R 33/9756; H01R 35/04; H01R 13/24; H01R 13/2407; H01R 13/245; H01R 13/2457; H01R 13/625; H01R 13/631; H01R 13/6315; F21S 8/026; F21K 9/30

See application file for complete search history.

(56) References Cited

U.S. PATENT DOCUMENTS 3,902,057 A * 8/1975 La Violette ..... F21S 48/255 340/431

2008/0274641 A1 11/2008 Weber et al.

(Continued)

FOREIGN PATENT DOCUMENTS

DE 1589093 C 4/1970
DE 3329053 C2 2/1984

(Continued)

*Primary Examiner* — Elmito Breval
*Assistant Examiner* — Steven Horikoshi
(74) *Attorney, Agent, or Firm* — Von Rohrscheidt Patents

(57) ABSTRACT

A lamp holder for receiving a lamp including a LED, the lamp holder including locking cams radially extending from a lamp base; a central heat conducting element; a lamp holder housing component that is attachable by fasteners at a light fixture component; a central cut-out for receiving the lamp base, wherein the cutout is enclosed by a lamp holder housing wall which is provided with insertion grooves which are oriented substantially perpendicular to the light fixture component; locking grooves respectively originating from the insertion grooves which locking grooves are oriented parallel to the light fixture component for receiving the locking cams extending from the lamp base; and at least one spring element, wherein the holder housing component including the locking grooves is liftable against a spring force of the at least one spring element through an insertion and rotation movement when inserting and locking the lamp.

9 Claims, 5 Drawing Sheets

(51) Int. Cl.

| | |
|---|---|
| ***F21V 29/50*** | (2015.01) |
| ***F21V 29/00*** | (2015.01) |
| ***F21K 99/00*** | (2016.01) |
| *F21V 17/14* | (2006.01) |

(56) References Cited

U.S. PATENT DOCUMENTS

2012/0106177 A1* 5/2012 Blankestijn ..... F21V 17/14
362/382

2013/0286669 A1* 10/2013 Moser ..... F21V 19/001
362/382

FOREIGN PATENT DOCUMENTS

| | | | |
|---|---|---|---|
| DE | 69934368 | T2 | 4/2007 |
| DE | 102009040115 | B4 | 10/2007 |
| EP | 2306035 | A1 | 4/2011 |
| WO | WO0212788 | A1 | 2/2002 |
| WO | WO2009150590 | A1 | 12/2009 |

* cited by examiner

LAMP HOLDER FOR RECEIVING A LAMP WITH HOLDER HOUSING COMPONENT LIFTABLE AGAINST SPRING FORCE

RELATED APPLICATIONS

This application is a continuation of International patent application PCT/DE2012/001202 filed on Dec. 14, 2012 claiming priority from German patent application 10 2012 005 539.0 filed on Mar. 21, 2012, both of which are incorporated in their entirety by this reference.

FIELD OF THE INVENTION

The invention relates to a lamp holder for receiving a lamp including a LED, the lamp holder including locking cams extending radially from a lamp base, and a central heat conducting element, including a holder housing component that is attachable by fasteners on a lamp component, and including a central cut-out for receiving the lamp base, wherein the cutout is enclosed by a holder housing wall which is provided with insertion grooves which are oriented substantially perpendicular to the lamp component, and locking grooves are provided starting from each of the access grooves which locking grooves are aligned parallel to the lamp component for receiving the locking cams at the lamp base, and including at least one spring element against the spring force of which the holder housing component provided with the locking grooves is liftable through an insertion and rotation movement when inserting and locking the lamp.

BACKGROUND OF THE INVENTION

Applicant has published a lamp base of this general type in her product catalog "LED Bridging" on page 30 as article number 28.107. The holder recited therein receives a lamp base which is fixated by a bayonet type insertion and rotation movement. The housing for the lamp holder is configured in two components, wherein an inner holder housing component is moveable relative to an outer holder housing component. Attachment devices configured as threaded bolts retain coil springs supported between both housing components, wherein the inner housing component is liftable against a reset force of the coil spring during fixation of the lamp base through locking cams. An embodiment with the product designation 28.301 on page 34 of the catalog recited supra illustrates a configuration that is similar in principle. Different from the prior embodiment this embodiment has a one piece housing. Also here coil springs supported by the shaft of the threaded bolt are supported at the holder housing on one side and at a head of the threaded bolt on the other side. Also here the lamp base lifts the holder housing against reset forces of the coil springs during fixation of the lamp base in the holder.

The coil springs generate a force upon the lamp base which presses the heat conducting element against the lamp component so that the surface pairing of heat conducting element and lamp component is subjected to a uniform and defined contact pressure. This contact pressure facilitates heat transfer from the lamp to the lamp component optionally using additional heat transfer devices like heat transfer paste or heat transfer foil wherein the lamp component is typically used as cooling element or explicitly configured as cooling element. Providing heat dissipation is of great importance in particular when using lamps that are provided with LEDs. Only sufficient heat dissipation provides a long service life for the lamp.

In order to prevent damaging the holder element when attaching the recited lamp holders of the applicant at a lamp component, non standard threaded bolts are used whose threaded shaft transitions into a bolt shaft through a diameter enlarging contact shoulder. This assures that the threaded bolt shaft can only be threaded into a corresponding threaded bore hole up to a defined depth. Accordingly the threaded bolt is sized so that the holder is correctly attached at the lamp component but not damaged by the tightening torque.

Holders with one piece housing of this general type are known in the art and not included in any printed document, wherein attachment openings of the holders are penetrated by a hollow rivet. The base housing is moveable relative to the respective hollow rivet. A coil spring element is inserted between the head of the hollow rivet and a stop configured by the housing in the attachment bore hole, wherein the coil spring element applies the advantageous preload upon a heat conducting element of an applied lamp base. In order to provide attachment at a lamp component a threaded bolt is run through the hollow rivet, wherein a head of the threaded bolt contacts the head of the hollow rivet in order to limit the threading operation and in order to limit the tightening torque, whereas the base of the hollow rivet is supported at the lamp component.

The recited embodiments have proven suitable in practical applications, but there is a long felt need for improvement for particular applications. It has been found to be advantageous when the spring element is preloadable already during mounting of the holder in order to increase heat transfer improving contact forces between the contact surfaces of the base side heat transfer element and the lamp component. From a production cost point of view it is desirable to be able to use standardized attachment elements which are cheaper to manufacture and which are easier to handle when applying the spring preload.

BRIEF SUMMARY OF THE INVENTION

It is an object of the invention to provide a lamp holder which implements the improvements recited supra.

The object is achieved by a lamp holder for receiving a lamp including a LED, the lamp holder including locking cams radially extending from a lamp base; a central heat conducting element; a lamp holder housing component that is attachable by fasteners at a light fixture component; a central cut-out for receiving the lamp base, wherein the cutout is enclosed by a lamp holder housing wall which is provided with insertion grooves which are oriented substantially perpendicular to the light fixture component; locking grooves respectively originating from the insertion grooves which locking grooves are oriented parallel to the light fixture component for receiving the locking cams extending from the lamp base; and at least one spring element, wherein the holder housing component including the locking grooves is liftable against a spring force of the at least one spring element through an insertion and rotation movement when inserting and locking the lamp, characterized in that the at least one spring element is preloaded by one of the fasteners and a preload stop of the at least one spring element contacts the light fixture component and limits the preload.

It is an essential advantage of the invention that the spring element itself forms the stop which limits the penetration depth of the attachment element in the light fixture component. Through advantageous arrangement of the component building up the spring preload and of the stop relative to each other the preload stop facilitates predetermining the maximum preload of the spring element through the fastener element. This preload is determined by the desired contact forces between the base side heat conducting element and the light fixture component in order to optimize heat transfer from the base to the cooling element. Simultaneously the preload stop limits the maximum attachment torque which is applied to the holder housing for fixating the holder housing.

A particularly advantageous embodiment provides that the spring element includes a spring arm that is supported at the holder housing wherein the spring arm extends from an assembly bridge which forms the preload stop and which is supported by the fastener element In this case the spring element is configured in general as a leaf spring which is producible in a cost effective manner and adaptable through a respective material selection or through heat treatment with respect to its spring elastic properties. In particular the spring element including the preload stop can be stamped from a suitable material and bent and produced in one process step.

In order to facilitate assembly it is provided that the spring element is supported in preassembled condition in the holder through at least one interlocking device at the spring element side.

Thus, it is provided in particular that the mounting bridge forms at least one interlocking device which interlocks in the holder housing for the purpose of providing a preassembly.

It is provided in another particularly advantageous embodiment that the spring element is protected against a build up of forces that leads to plastic deformations in that the spring element is arranged above a holder side mounting dome which forms a lifting stop which limits a lifting movement of the holder housing.

It is furthermore provided that the mounting bridge includes at least one support arm that is advantageously oriented perpendicular to the light fixture component and which forms the preload stop and a retaining arm that is oriented essential parallel to the lamp element and which is penetrated by the attachment device.

In an advantageous embodiment of the invention it is provided that the mounting dome is supported at the retaining arm and forms a lifting stop, wherein the mounting dome is penetrated by the fastener element.

Thus, it can be provided that the mounting dome and the retaining arm are arranged along a shaft of the fastener element and moveable relative thereto.

It is furthermore provided that two spring arms extend from the mounting bridge in opposite directions.

Eventually it is conceivable that the spring arm is shape adapted to the storage cavity within the holder housing and in particular configured arcuate.

BRIEF DESCRIPTION OF THE DRAWINGS

Further advantages of the invention and improved understanding thereof can be derived from the subsequent description of an embodiment with reference to drawing figures, wherein.

DETAILED DESCRIPTION OF THE INVENTION

Figure 1:
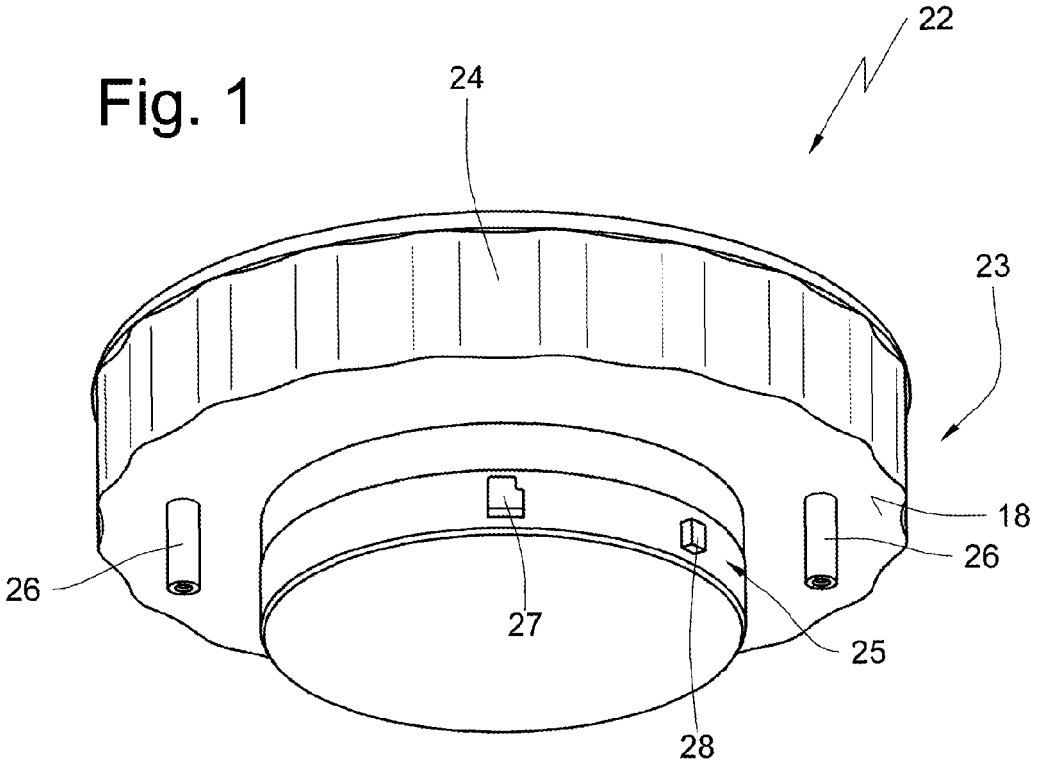
FIG. 1 illustrates a lamp base for support in a holder according to the invention in a perspective view from below.

A holder according to the invention is designated overall with reference numeral 10 in the Figures.

Figure 2:
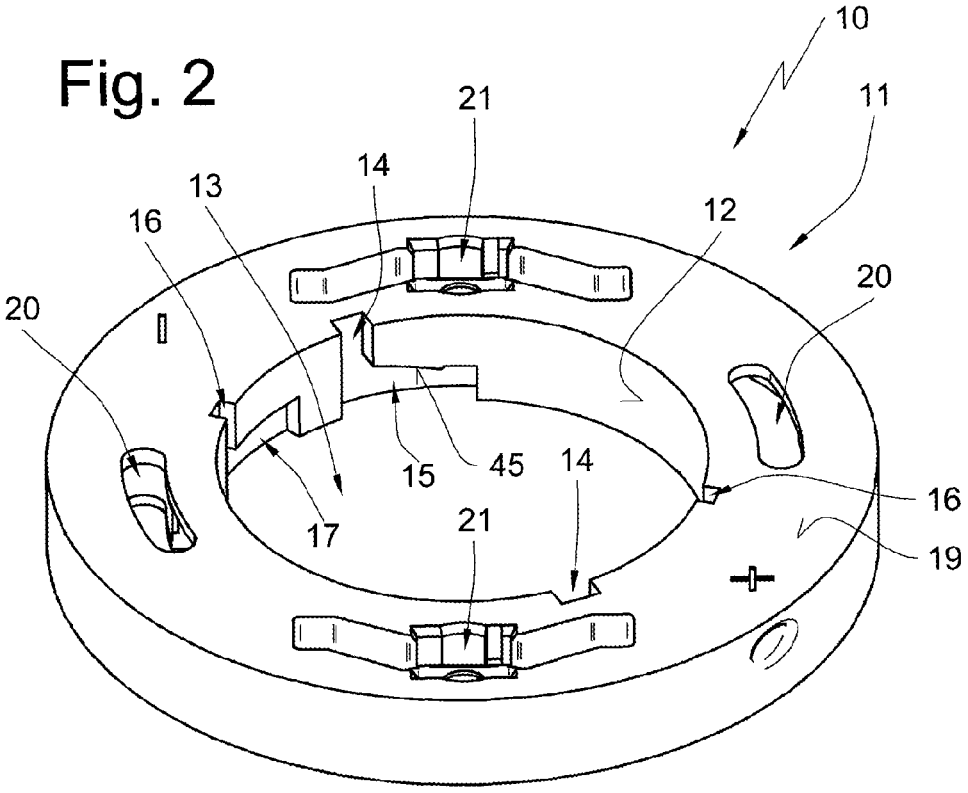
FIG. 2 illustrates a holder according to the invention in a perspective view from above.

The holder 10 illustrated in FIG. 2 in a perspective view includes a holder housing component 11 whose inner holder housing wall 12 envelops a central essentially circular cylindrical cut out 13.

Insertion grooves 14 are configured in the holder housing component 11, namely in an inner holder housing wall 12, wherein the insertion grooves are oriented perpendicular to a non illustrated light fixture element or in insertion direction of a lamp base 23, wherein the insertion grooves transition into locking grooves 15 oriented essentially parallel to the non illustrated light fixture component. Additional vertical grooves 16 with horizontal grooves 17 adjoining thereto are used for encoding devices through which lamp types are definable that are insertable into the holder 10.

A cover wall 19 that is oriented parallel to the non illustrated light fixture component and parallel to a base bottom 18 (cf. FIG. 1) initially includes base contact cutouts 20 that are configured as slotted holes and additionally receiving clamps 21 for spring elements.

Figure 3:
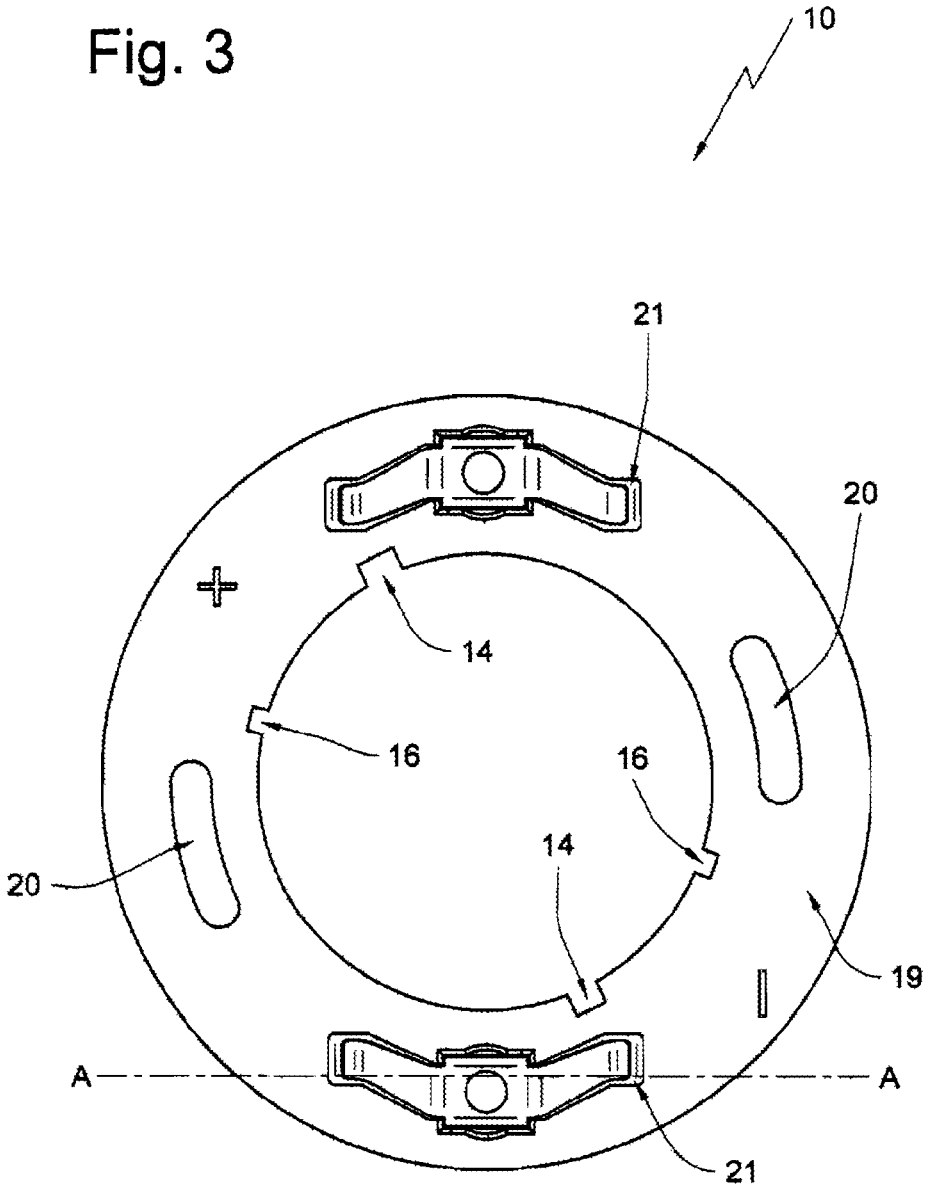
FIG. 3 illustrates the holder according to the invention according to FIG. 2 in a top view.

The holder 10 illustrated in FIGS. 2 and 3 is used for receiving a lamp overall designated with reference numeral 22.

The lamp 22 includes a lamp base 23 from whose base housing 24 an essentially circular cylindrical heat transfer element 25 extends towards the holder.

Base contact pins 26 extend from a base bottom 18 which is concentrically arranged about the heat conducting element 25, wherein the base contact pins correspond to the base contact cut outs 20 of the holder 10 with respect to their position and arrangement.

Radially oriented locking cams 27 extend from a circumferential surface of the heat conducing element 25 in a radial direction as well as encoding cams designated with reference numeral 28. The locking cams 27 correspond to the insertion grooves 14 and the locking grooves 15, the encoding cams 28 correspond to vertical grooves 16 and horizontal grooves 17.

Figure 4:
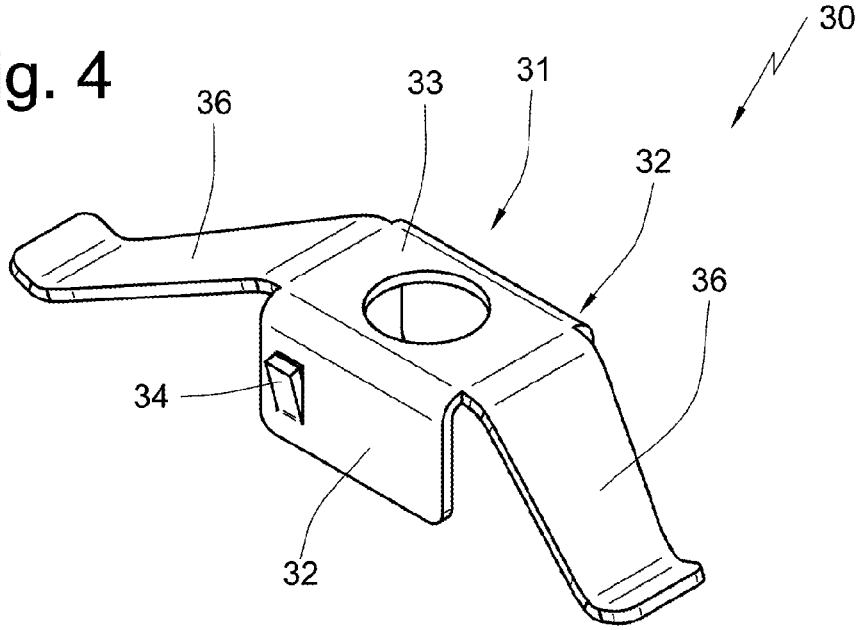
FIG. 4 illustrates a spring element according to the invention in a perspective view.
Figure 5:
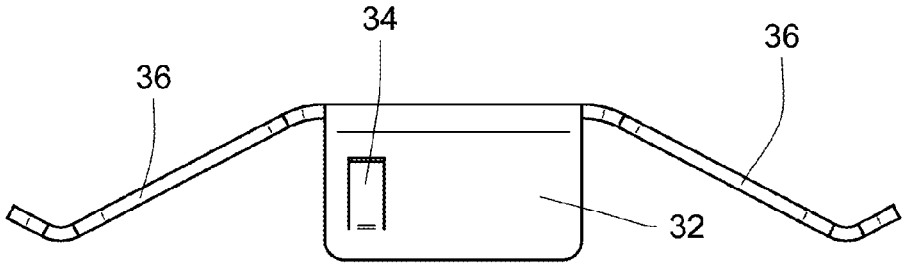
FIG. 5 illustrates the spring element according to FIG. 4 in a lateral view.
Figure 6:
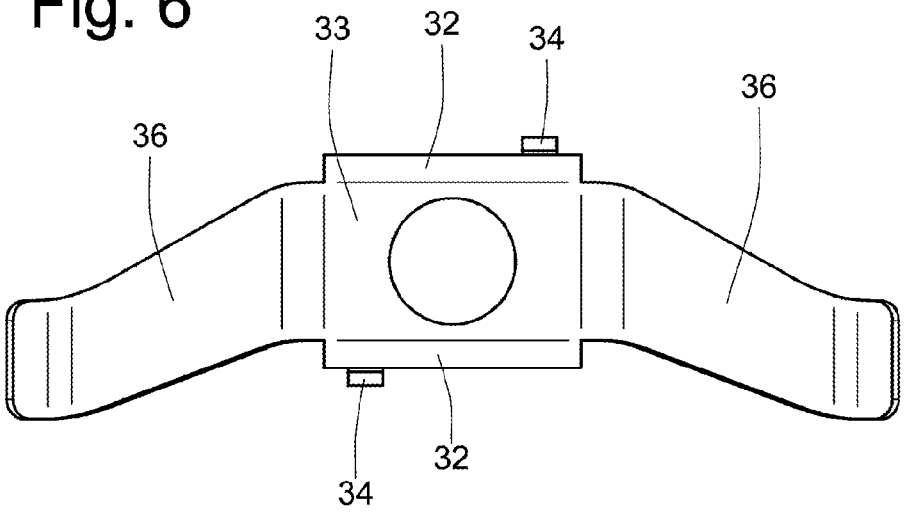
FIG. 6 illustrates the spring element according to FIG. 4 in a view from above.

It can be derived from FIG. 3 which is a top view of the holder 10 that spring elements that are overall designated with reference numeral 30 are arranged in the receiving cavities 21, wherein the spring elements are described in more detail infra. Thus, reference is made initially to the perspective view of the spring element 30 in FIG. 4. The spring element provided overall with reference numeral 30 includes a central mounting bridge 31 which is formed by two support arms 32 and a retaining arm 33 connecting the support arms 32. At least one of the support arms 32, advantageously, however, both support arms 32 are respectively provided with an interlocking device 34, whereas the retaining arm 33 includes a pass through bore hole 35.

Two spring arms 36 that are oriented in opposite directions extend from the assembly bridge 31, wherein the spring arms subsequently establish contact pressure facilitating heat transfer from the heat conducting element 25 to a non illustrated light fixture component 40.

Figure 7:
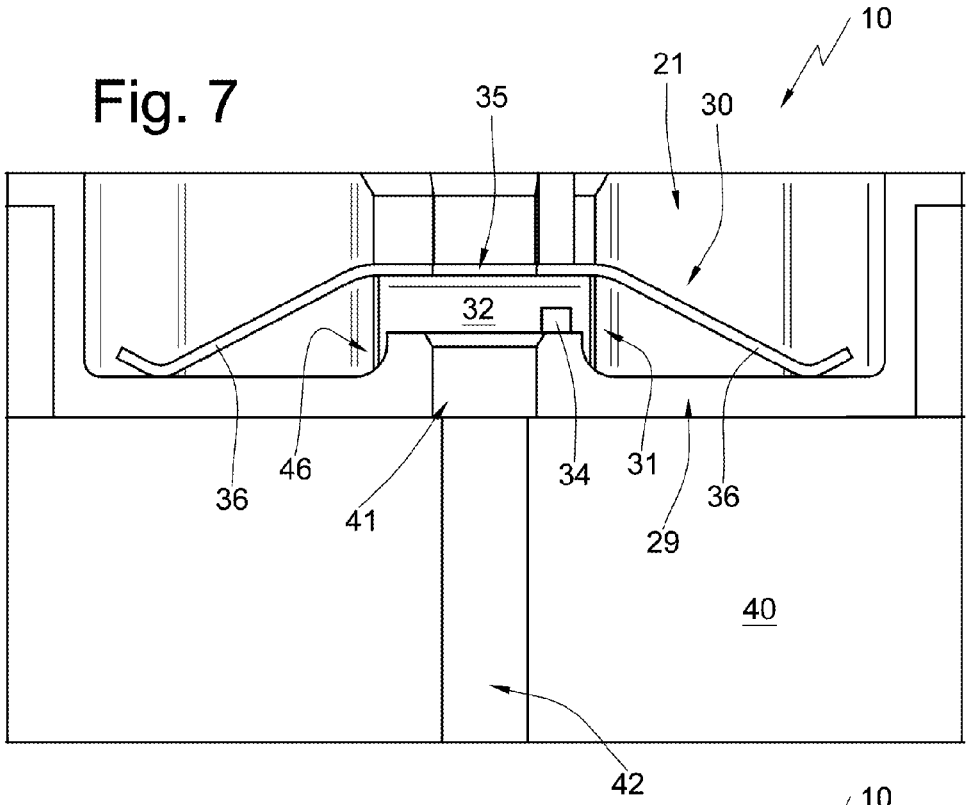
FIG. 7 illustrates a sectional view of the holder housing according to the invention according to section line A-A in FIG. 3 with the spring element in a pre assembled condition.

FIG. 7 illustrates a sectional view of the lamp holder 10 according to the sectional line A-A in FIG. 3. The illustration shows a view into the receiving cavity 21 and the spring element 30 arranged therein. Additionally, a light fixture component 40 is illustrated which is used as a cooling element.

It is apparent from FIG. 7 that the holder housing base 29 is provided with an attachment bore hole 41 which is aligned with the pass through bore hole 35 and a threaded bore hole 42 of the light fixture component 40.

FIG. 7 illustrates a preassembled condition of the spring element 30. Thus, the spring element 30 has been inserted into the receiving cavity 21, wherein the interlocking device 34 of the mounting bridge 31, which interlocking device is configured as an interlocking spring, is seated in an interlocking recess in the holder housing component which is not illustrated in detail.

Figure 8:
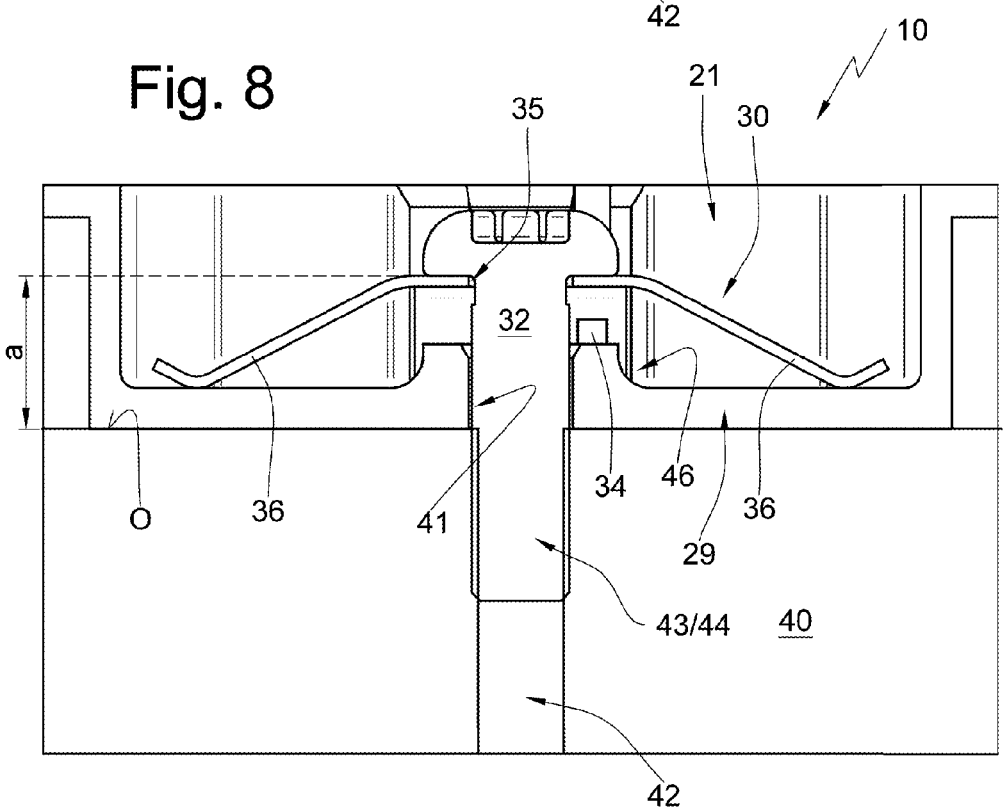
FIG. 8 illustrates the sectional view according to FIG. 7 with an inserted threaded bolt.

It is illustrated in FIG. 8 how a fastener element 43 configured as a threaded bolt 44 is pushed through the pass through bore hole 35 of the spring element 30 and the attachment bore hole 41 of the holder housing base 29 and turned into the threaded bore hole 42 in order to attach the holder 10 at the light fixture component 40 until a bottom of the head of the threaded bolt contacts the support arm 32 of the spring element 30. In this condition illustrated in FIG. 8 the retaining arm 33 of the spring element 30 is arranged at a distance from the surface O of the light fixture component 40.

Figure 9:
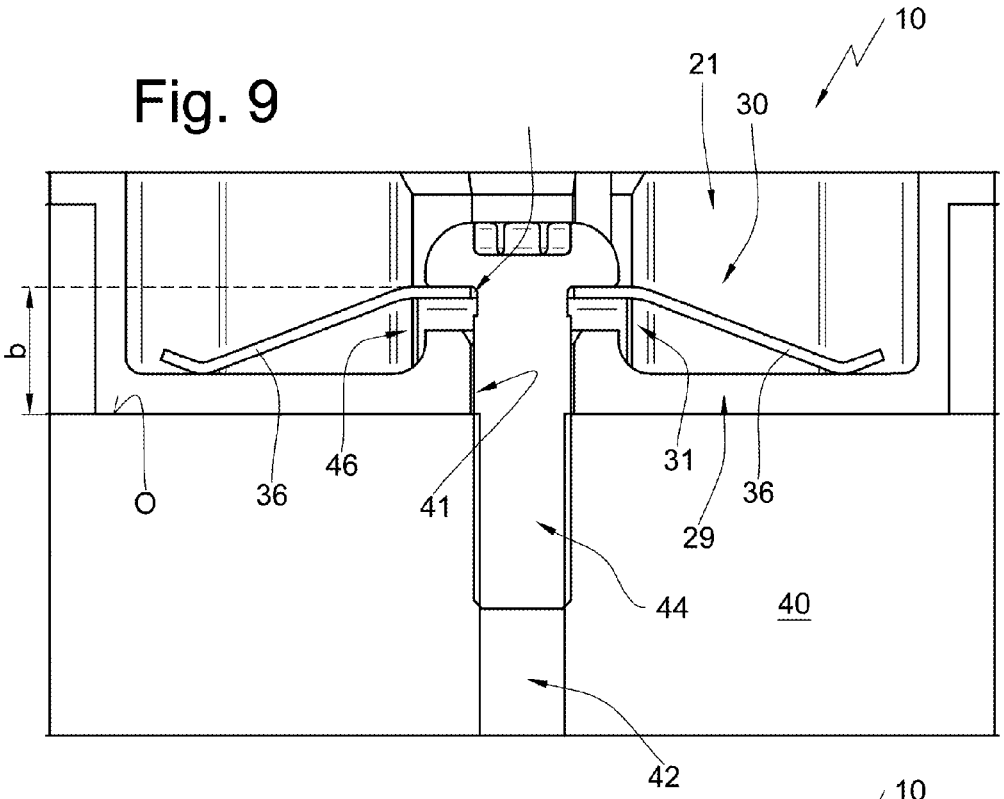
FIG. 9 illustrates the sectional view according to FIG. 8 with a spring element that is preloaded by the threaded bolt.

In FIG. 9 the threaded bolt 44 has been twisted further into the threaded bore hole 42 compared to the position in FIG. 8. Thus, also the mounting bridge 31 is moved in a direction towards the light fixture component 40 until the support arms 32 contact the surface O of the light fixture component 40 so that they prevent further displacement.

The spring arms 36 which continue to contact the holder housing base 29 during displacement of the mounting bridge are preloaded correspondingly and build up spring reset forces. The support arms 32 are thus used as a preload stop since they limit the preload movement of the mounting bridge 31 of the spring element 30.

Figure 10:
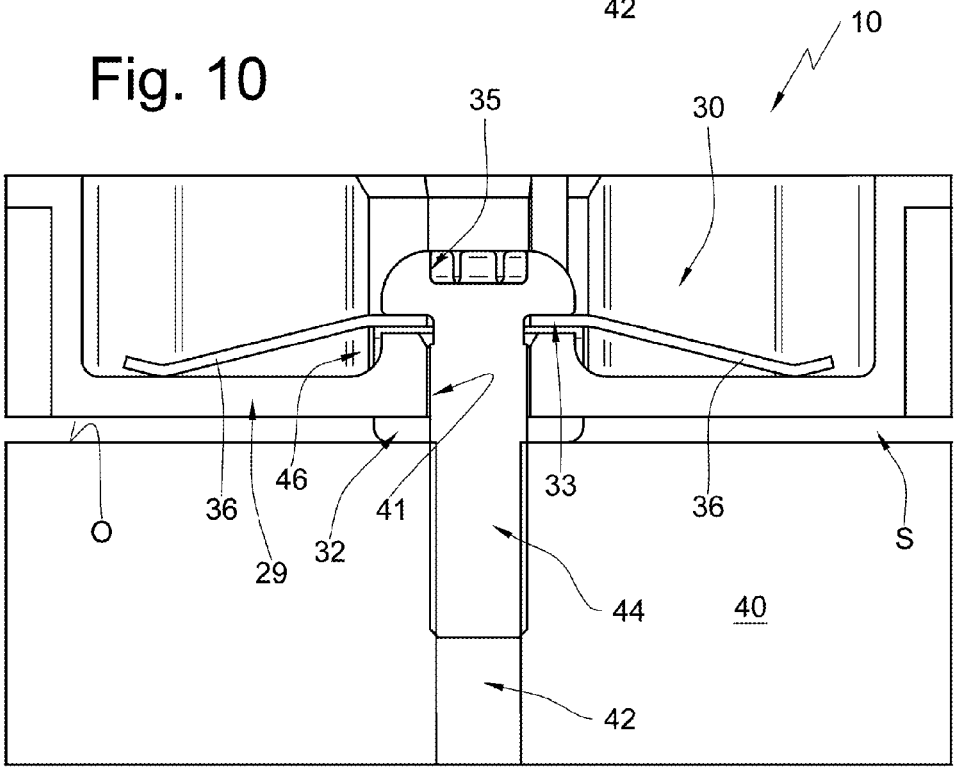
FIG. 10 illustrates the sectional view according to FIG. 9 incorporating a representation of a maximum spring preload.

In order to further describe FIG. 10 reference is made to FIGS. 1 and 2 initially.

In order to fixate the lamp 22 illustrated in FIG. 1 in the holder 10 illustrated in FIG. 2 the lamp is inserted into the recess 30 with the heat conducting element 25, wherein locking cams 27 and encoding cams 28 are in alignment with the respective insertion grooves 14 and the vertical grooves 16. The base of the heat conducting element contacts the surface O of the light fixture component 40 not illustrated in FIG. 2 in order to dissipate operating heat from LED elements arranged in the lamp 22 through the heat transfer element 25 to the light fixture component 40. The locking cams 27 are now arranged in an insertion portion of the locking grooves 15 whose wall includes an insertion and clamping bevel 45 which is inclined towards the light fixture component 40.

The holder 10 is moveable along the threaded bolt shafts relative to the light fixture component 40. The locking cams 27 and the locking grooves 15 are arranged or sized relative to each other so that the holder housing element 11 is lifted when the locking cams 27 slide down at the clamping bevel 45 so that the gap S illustrated in FIG. 10 is created in the holder 10 and in the light fixture component 40.

The spring element 30 contacts the head of the threaded bolt with its retaining arm 33 and is supported by the head of the threaded bolt. A movement of the spring element 30 relative to the light fixture component 40 is thus excluded. As a consequence the spring load of the spring arms 36 is increased through the relative movement of the holder 10. The simultaneous force coupling between the holder 10 and the base 23 through the arrangement of the locking cams 27 in the locking grooves 15 causes spring reset forces to impact the lamp base 23. As a consequence the spring elements 30 load the contact surfaces of the light fixture component 40 and the base of the heat conducting element 25 with an even contact pressure which facilitates heat transfer.

Last not least the mounting dome 46 is described which is formed by the holder base 29. The mounting dome envelops the attachment bore hole 41 of the holder 10 and is therefore arranged below the retaining arm 33. The mounting dome 46 is used as a lifting stop which is supported at the retaining arm 33 when the holder 10 is lifted so that the lifting movement is limited by a lifting stop. This way an overextension of the spring arms 36 and a plastic deformation resulting therefrom is prevented which would cause damage to the spring elements 30. This way it is assured that the spring elements 30 can provide the required contact forces safely and permanently.

REFERENCE NUMERALS AND DESIGNATIONS

10 holder
11 holder housing element
12 inner holder housing wall
13 cutout
14 insertion groove
15 locking groove
16 vertical groove
17 horizontal groove
18 base bottom side
19 cover wall
20 base contact recess
21 receiving cavity
22 lamp
23 lamp base
24 base housing
25 base side heat conducting element
26 base contact pins
27 locking cam
28 encoding cam
29 holder housing bottom
30 spring element
31 mounting bridge
32 support arm of 31
33 retaining arm
34 interlocking device
35 pass through bore hole of 33
36 spring arm
40 light fixture component
41 attachment bore hole of 29
42 threaded bore hole

43 fastener element
44 threaded bolt
45 clamping bevel
46 mounting dome
a offset
b offset
O surface of 40
S gap

What is claimed is:

1. A lamp holder for receiving a lamp including a LED, the lamp holder comprising:

locking cams radially extending from a lamp base;

a central heat conducting element;

a lamp holder housing component that is attachable by at least one fasteners to a light fixture component;

a central cut-out for receiving the lamp base, wherein the cutout is enclosed by a lamp holder housing wall which is provided with insertion grooves which are oriented substantially perpendicular to the light fixture component;

locking grooves respectively originating from the insertion grooves which locking grooves are oriented parallel to the light fixture component and configured for receiving the locking cams extending from the lamp base; and at least one spring element, wherein the holder housing component including the locking grooves is liftable from the light fixture component against a spring force of the at least one spring element through an insertion and rotation movement when inserting and locking the lamp, wherein the at least one spring element is preloaded by the at least one fastener and a preload stop of the at least one spring element contacts the light fixture component and limits the spring force, wherein the spring element is arranged above a mounting dome at the lamp holder, and wherein the mounting dome forms a lift stop limiting a lift movement of the holder housing component from the light fixture component.

2. The lamp holder according to claim 1, wherein the spring element includes a spring arm that is supported at the holder housing component and extends from a mounting bridge, and wherein the mounting bridge forms the preload stop and is supported by the at least one fastener.

3. The lamp holder according to claim 2, wherein the mounting bridge includes at least one support arm that is advantageously oriented perpendicular to the light fixture component and forms the preload stop, wherein the mounting bridge includes a retaining arm oriented essentially parallel to the light fixture component, and wherein the retaining arm is penetrated by the at least one fastener.

4. The lamp holder according to claim 2, wherein two spring arms extend in opposite directions from a mounting bridge.

5. The lamp holder according to claim 2, wherein a shape of the spring arm is adapted to a storage space within the lamp holder housing and in particular configured arcuate.

6. The lamp holder according to claim 1, wherein the spring element is supported preassembled in the lamp holder by at least one interlocking device arranged at the spring element.

7. The lamp holder according to claim 6, wherein the mounting bridge forms the at least one interlocking device which interlocks in the lamp holder housing for pre assembly.

8. The lamp holder according to claim 1, wherein the mounting dome is supported at the retaining arm and forms a lift stop, wherein the mounting dome is penetrated by the at least one fastener.

9. The lamp holder according to claim 8, wherein the mounting dome and the retaining arm are arranged along a shaft of the at least one fastener and movable relative thereto.

* * * * *